US007896132B2

(12) United States Patent
O'Gorman

(10) Patent No.: US 7,896,132 B2
(45) Date of Patent: Mar. 1, 2011

(54) MULTI-LEVEL FALL PROTECTION SYSTEM FOR HIGH-RISE CONSTRUCTION

(75) Inventor: Dennis O'Gorman, Middletown, NY (US)

(73) Assignees: Carmine F. Datello, Jr., Staten Island, NY (US); Dennis O'Gorman, Middletown, NY (US)

( * ) Notice: Subject to any disclaimer, the term of this patent is extended or adjusted under 35 U.S.C. 154(b) by 675 days.

(21) Appl. No.: 11/985,103

(22) Filed: Nov. 14, 2007

(65) Prior Publication Data

US 2008/0110117 A1 May 15, 2008

Related U.S. Application Data

(60) Provisional application No. 60/859,205, filed on Nov. 15, 2006.

(51) Int. Cl.
*E04B 1/20* (2006.01)

(52) U.S. Cl. ..... 182/112; 182/113; 256/59; 256/DIG. 6; 52/234; 52/236.3; 52/344; 52/349; 52/350; 52/380; 52/741.1; 52/745.19

(58) Field of Classification Search ..... 182/112, 182/113, 45, 82, 3, 36, 106; 256/59, 65.01, 256/65.02, 1, 6, 65.14, 63; 248/237; 52/79.1, 52/79.9, 79.12, 79.14, 234, 344, 236.3, 236.5, 52/443–444, 299, 294, 449, 380, 742.14, 52/745.05, 745.09, 745.12, 745.17, 745.19, 52/747.11, 749.11

See application file for complete search history.

(56) References Cited

U.S. PATENT DOCUMENTS

| | | | | |
|---|---|---|---|---|
| 1,244,670 | A * | 10/1917 | Whitney | 182/113 |
| 2,037,482 | A * | 4/1936 | Oliver | 52/236.8 |
| 3,101,127 | A * | 8/1963 | Fougea | 182/147 |
| 3,880,504 | A * | 4/1975 | Marvin | 352/29 |
| 4,037,824 | A | 7/1977 | Whitmer | |
| 4,129,197 | A * | 12/1978 | Preston | 182/82 |
| 6,053,281 | A * | 4/2000 | Murray | 182/113 |
| 6,173,809 | B1 * | 1/2001 | Cole et al. | 182/3 |
| 6,691,826 | B1 | 2/2004 | Dean | |
| 6,763,910 | B2 | 7/2004 | Cole | |
| 6,779,630 | B2 * | 8/2004 | Choate | 182/36 |
| 6,966,531 | B2 | 11/2005 | Curtin | |
| 7,048,090 | B2 * | 5/2006 | Dean et al. | 182/3 |
| 7,063,186 | B1 * | 6/2006 | Granke | 182/113 |
| 2001/0032435 | A1 | 10/2001 | Austin | |

* cited by examiner

*Primary Examiner*—Jeanette E. Chapman
(74) *Attorney, Agent, or Firm*—Collard & Roe, P.C.

(57) ABSTRACT

A multi-level fall protection system for a structure under construction, the structure having reinforced concrete decks including a first deck and a second deck arranged above the first deck and openings provided in the decks. The system includes bearing plates arranged in an associated opening in the first deck and having a flange portion larger than the associated opening. Lateral support blocks are arranged in an associated opening in the second deck. Vertical support posts are detachably secured at a bottom portion to an associated bearing plate and extend upwardly through an associated opening in the second deck. The vertical support posts are supported laterally by the lateral support blocks. At least one flexible support line extends between and is coupled to a pair of the vertical support posts.

14 Claims, 19 Drawing Sheets

MULTI-LEVEL FALL PROTECTION SYSTEM FOR HIGH-RISE CONSTRUCTION

CROSS REFERENCE TO RELATED APPLICATIONS

This application claims the benefit of U.S. Provisional Patent Application No. 60/859,205 filed Nov. 15, 2006.

BACKGROUND OF THE INVENTION

1. Field of the Invention

The invention relates to a multi-level fall protection system for a structure under construction and a method for providing such a system. More particularly, the invention relates to a multi-level fall protection system for a structure having multiple reinforced concrete decks, wherein flexible support lines are anchored to vertical support posts which extend between multiple decks, thereby providing fall prevention and/or fall arrest capabilities on multiple levels of the structure.

2. The Prior Art

Presently-used measures for preventing and/or arresting falls during high rise construction include wood planking loosely set in supports around the perimeter of a floor under construction, and harness systems worn by workers which are tethered to a support line consisting of a strap secured to an eye protruding out of the poured concrete. Other systems include horizontal netting supported by poles extending out from the construction site. These nets however are meant to stop and catch falling debris, not personnel.

The following references, the disclosures of which are incorporated herein by reference, relate to various fall protection systems.

U.S. Patent Application Publication No. 2001/0032435 to Austin describes a portable fall-arrest system temporarily attached to the reinforced concrete deck of a structure under construction. Threaded shafts are threaded into internally threaded inserts embedded in the concrete flooring or inserted through holes formed in the concrete flooring and secured with flanged nuts. Stanchions having a tubular posts and base plates are placed over the threaded shafts and a safety cable is strung between connector plates on two or more stanchions.

U.S. Pat. No. 6,691,826 to Dean describes a safety apparatus for construction workers working in elevated locations. The apparatus includes anchor members in the form of support posts which have flanged bases at their lower ends for clamping to an I-beam flange using a nut and bolt arrangement. Each support post has a radially extending lug on its upper end with an opening defined therein for receiving or securing a safety line. As shown in U.S. Pat. No. 7,048,090 to Dean et al., the support posts can have an I-shaped cross sectional configuration and can be clamped to a precast concrete structure, such as a concrete tilt panel.

U.S. Pat. No. 6,779,630 Choate shows a rebar stanchion horizontal lifeline fall arrest system wherein elongated tubular stanchions are slid over a section of rebar projecting from a reinforced concrete floor. The stanchions are supported with flexible guy members secured to additional projecting sections of rebar and a stanchion head slips over the top of the stanchion for supporting a cable lifeline.

U.S. Pat. No. 4,037,824 to Whitmer shows a safety post with a horizontal leg adapted to be detachably clamped to a structural beam and an integral vertical leg for retaining a safety cable.

U.S. Pat. No. 6,053,281 to Murray shows a safety rail system for installing around the perimeter of a rooftop work site. The system includes a plurality of vertical stanchions having links for receiving a safety cable tensioned with a winch. Each stanchion is supported in a sleeve portion of a hinged base plate and secured with a locking pin. The base plates are attached with appropriate fasteners to a vertical wall surface of the building and a second surface forming an edge with the vertical surface.

U.S. Pat. No. 6,763,910 to Cole shows a roof structure having safety stanchions mounted directly to a building roof for supporting a safety cable. The safety stanchions are secured to the roof structure at the intersections of the roof rafters and purlins.

U.S. Pat. No. 6,173,809 to Cole et al. shows a safety stanchion for supporting and anchoring a safety cable. The stanchion includes a tapered tubular post having an upper end for supporting a safety cable and a lower end attached to a support base that is mounted to a flanged structural beam.

U.S. Pat. No. 6,966,531 to Curtin shows a roof anchor for securing a safety line to the rafter of a timber roof frame.

Although a number of fall protection systems are known, a need exists for a multi-level fall protection system for a structure under construction which provides fall prevention and/or fall arrest on multiple levels of the structure, for example on multiple reinforced concrete decks or floors of a structure. Moreover, a need exists for a multi-level fall protection system which can be quickly and easily assembled, adapted to the particular structure as it is constructed, disassembled and re-used on additional structures.

SUMMARY OF THE INVENTION

An embodiment of the invention provides a multi-level fall protection system for a structure under construction, the structure having a plurality of reinforced concrete decks with a plurality of openings provided in the decks, the plurality of decks including a first deck and a second deck arranged above the first deck. The multi-level fall prevention system includes a plurality of bearing plates, each of the plurality of bearing plates arranged in an associated opening in the first deck and comprising a flange portion larger than the associated opening.

The system further includes a plurality of lateral support blocks, each of the plurality of lateral support blocks being arranged in an associated opening in the second deck. Each of a plurality of vertical support posts are detachably secured at a bottom portion to an associated bearing plate and extend upwardly through an associated opening in the second deck. The vertical support posts are supported laterally by an associated lateral support block. At least one flexible support line extends between and is coupled to a pair of the vertical support posts.

In a further aspect of the invention, the vertical support posts have a plurality of spaced apart openings therethrough for receiving a respective fastener. The fastener secures an end of the flexible support line to the vertical support post.

In a further aspect of the invention, at least one of the vertical support posts comprises a plurality of tubular sections coupled together. In another aspect, a tensioning mechanism is coupled to at least one of the flexible support lines.

In a further aspect of the invention, a plurality of flexible support lines extend between and are coupled to a plurality of pairs of vertical support posts. At least one of the flexible support lines may serve as a handrail for preventing a fall and at least one of the flexible support lines may serve as a lifeline for arresting a fall. The plurality of flexible support lines may form a plurality of handrails extending around a perimeter of a deck. The plurality of flexible support lines may form a plurality of lifelines extending along an interior portion of a deck.

In a further aspect, at least one of the bearing plates includes a connection member projecting upwardly from its flange portion, wherein the connection member is sized and shaped to receive the bottom portion of a vertical support post. The connection member may have a first opening therethrough, and the bottom portion of the vertical support post may have a second opening therethrough, wherein the bottom portion of the vertical support post is detachably secured to the connection member with a pin inserted through the first and second openings.

In a further aspect, at least one of the lateral support blocks includes a flange portion larger than the associated opening in the second deck and a substantially central opening for allowing a vertical support post to pass through the lateral support block. The lateral support block may comprises at least two lateral support block sections arranged in proximity to one another to form the substantially central opening.

An additional aspect of the invention provides a method for providing a multi-level fall protection system for a structure under construction, the structure having a plurality of reinforced concrete decks with a plurality of openings provided in the decks, the plurality of decks including a first deck and a second deck arranged above the first deck. The method includes the steps of arranging each of a plurality of bearing plates in an associated opening in the first deck, wherein the bearing plates comprise a flange portion larger than the associated opening in the first deck; arranging each of a plurality of vertical support posts so as to extend upwardly from the first deck through an associated opening in the second deck; detachably securing a bottom portion of the vertical support posts to an associated bearing plate; arranging each of a plurality of lateral support blocks in an associated opening in the second deck for laterally supporting an associated vertical support post; and coupling at least one flexible support line to each of a pair of the vertical support posts so as to extend between the pair of vertical support posts.

A multi-level fall protection system and method according to embodiments of the invention have the advantage of providing fall prevention and/or fall arrest on multiple levels of a structure under construction, for example on multiple reinforced concrete decks or floors of a structure. A multi-level fall protection system and method according to embodiments of the invention further provide the advantages of rapid and simple assembly, adaptation to a particular structure as it is constructed, disassembly and re-use.

A further advantage of a multi-level fall protection system and method according to embodiments of the invention is that both fall prevention, through the use of flexible support lines serving as handrails and fall arrest, through the use of flexible support lines serving as lifelines, may be provided. Moreover, the handrails and/or lifelines may be configured to extend around the perimeter of the structure and/or the interior of the structure, thereby providing the capability for both perimeter and/or interior fall prevention and/or arrest.

Another advantage of a multi-level fall protection system and method according to embodiments of the invention is that the components of the system may be provided in modular, standardized sizes and/or lengths which results in significant cost savings over known systems as components may be disassembled when no longer needed and re-used on another project.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings, wherein similar reference characters denote similar elements throughout the several views.

DETAILED DESCRIPTION OF THE DRAWINGS

Figure 1D:
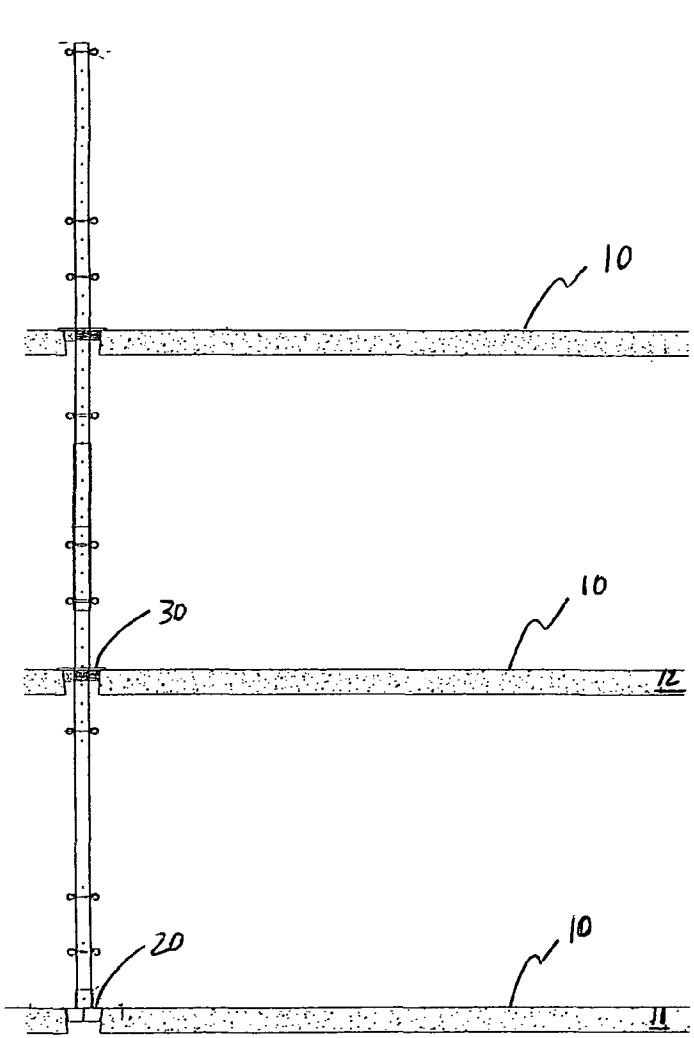
FIG. 1*d* shows a side view of a vertical support post extending between multiple reinforced concrete decks according to an embodiment of the invention.

The invention relates to a multi-level fall protection system for a structure under construction and a method for providing such a system. The structure under construction may be for example a multi-story or high-rise structure including a plurality of reinforced concrete decks 10 (FIG. 1*d*). The concrete decks or slabs 10 may include a first deck 11 and a second deck 12 arranged above first deck 11. First deck 11 may be a base or stripping floor, and second 12 and subsequent decks may be intermediate or erection floors. A system according to the invention may also provide fall protection for an uppermost or new deck comprising wood studs and plywood sheets for laying the next concrete floor. The terms first and second deck as used herein are relative terms and refer to any two levels, slabs or floors of the structure which are arranged one above the other.

Figure 4A:
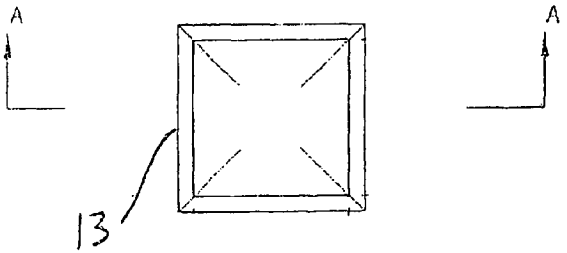
FIG. 4*a* shows a plan view of an opening in a reinforced concrete deck for a multi-level fall protection system according to an embodiment of the invention.
Figure 4B:
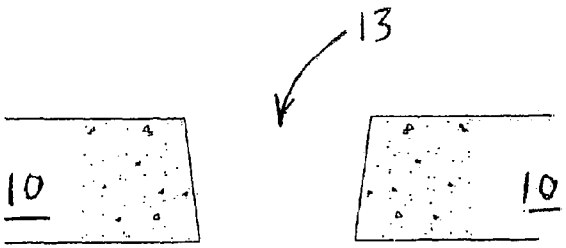
FIG. 4*b* shows a cross section along section AA of the opening shown in FIG. 4*a;*

A plurality of openings 13 are provided in each of first deck 11 and second deck 12. These openings may be formed by using an appropriately sized form or box, for example a wood box or "pack out" and casting the concrete around the form or box to provide an opening or void. Once the fall protection system is no longer needed and is removed, the openings may be filled with concrete or otherwise filled in or over. As shown in FIGS. 4*a* and 4*b*, the opening 13 in the deck have a substantially square tapered shape, with the opening being larger on a top surface of the deck and gradually tapering to a smaller opening on the lower surface of the deck. For example, an opening 13 may have a substantially square shape having sides of approximately twelve inches on the top surface of the deck and sides of approximately ten inches on the bottom surface of the deck. These sizes and dimensions are exemplary only, and openings 13 may be of any size and shape appropriate for arranging and supporting the various components of the multi-level fall protection system disclosed herein.

Figure 5A:
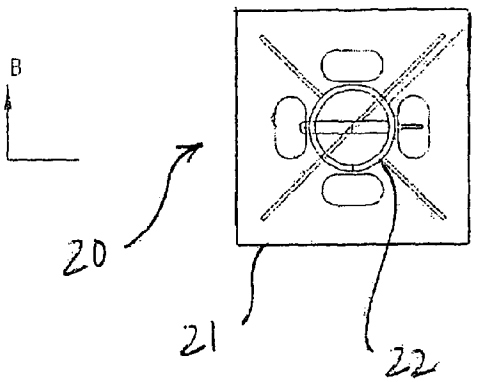
FIG. 5*a* shows a plan view of a bearing plate according to an embodiment of the invention.
Figure 5B:
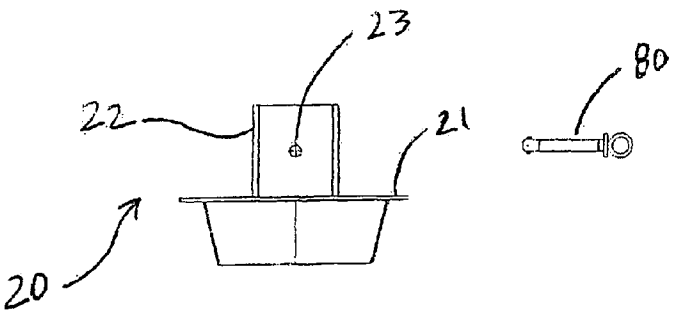
FIG. 5*b* shows a cross section along section BB of the bearing plate shown in FIG. 5*a;*

A plurality of bearing plates 20 are provided for supporting vertical support posts 40. Each of bearing plates 20 is arranged in an associated opening 13 in the first deck 11. FIGS. 5*a* and 5*b* show an example of a bearing plate 20 according to an embodiment of the invention. As shown, bearing plate 20 may include a flange portion 21 which is larger in size than the associated opening 13 in the respective deck. In this way, flange portion 21 prevents bearing plate 20 from passing through opening 13. Flange portion 21 may also include one or more handhold openings as shown in FIG. 5*a* to facilitate lifting and carrying bearing plate 20 as it inserted and removed from openings 13.

Bearing plate 20 and flange portion 21 may be formed from any suitable material providing sufficient support for the multi-level fall protection system, for example flange portion 21 may comprise a one quarter inch thick steel plate, having a substantially square shape with sides measuring approximately fifteen inches. These sizes and dimensions are exemplary only, and bearing plate 20 and flange 21 may be of any size and shape appropriate for arranging and supporting the various components of the multi-level fall protection system disclosed herein.

Bearing plate 20 may also include diagonal portions or plates which extend into opening 13 as shown in FIG. 5*b*. The diagonal plates may form a tapered structure substantially conforming to the tapered shape of opening 13, thereby seating bearing plate 20 in associated opening 13.

Bearing plate 20 may further comprise a connection member 22 projecting upwardly from flange portion 21. Connection member 22 is sized and shaped to receive a bottom portion of a vertical support post 40 to be secured to the bearing plate 20. For example, connection member 22 may include a length of round structural tube extending approximately six inches in height from flange 21. A vertical support post 40 may comprise a round tube having an inner and outer diameter such that a bottom portion of vertical support post 40 may be inserted into connection member 22 or over connection member 22, providing a secure fit. Connection member 22 and bottom portion of vertical support post 40 may of course comprise any other suitable shapes.

As shown in FIGS. 5*a* and 5*b*, connection member 22 may include a first opening 23 therethrough. The bottom portion of a vertical support post 40 may have a corresponding or second opening 41 therethrough, thereby allowing the bottom portion of the vertical support post 40 to be detachably secured to connection member 22 and bearing plate 20 with a pin 80 inserted through the first 23 and second 41 openings. Pin 80 may be any suitable fastener, such as, for example, a three quarter inch diameter stainless steel pin having detents or keepers at one end (FIG. 3), a nut and bolt arrangement or the like.

Although, bearing plates 20 are shown configured to support vertical support posts 40 substantially perpendicular to decks 10, bearing plates 20 may also be configured to support vertical support posts 40 at an angle. Moreover, bearing plates 20 may comprise a receiver cup projecting into opening 13 for receiving a bottom portion of a vertical support post.

Flange 21 may include outwardly extending tabs and a form may be used to produce an opening 13 in the cast concrete floor so that the opening is shaped to receive these tabs. In a further embodiment, square holes may be formed in the concrete floor and inserts may be used to form a round opening for accepting a round portion of the bearing plate 20.

A plurality of lateral support blocks or lateral bracing blocks 30 are provided for supporting a vertical support post 40 in a lateral direction. Lateral support blocks 40 are arranged in an associated opening 13 provided in the second deck 12 or subsequent decks arranged over first deck 11.

Lateral support blocks 30 may comprise appropriately sized sleeves or wedges removably inserted into opening 13 in an intermediate deck or floor for maintaining an associated vertical support post 40 in proper position and providing lateral support for the associated support post. Lateral support blocks 40 may be formed from any suitable material such as plastic, metal, rubber or wood, for example plywood or oak.

Figure 6A:
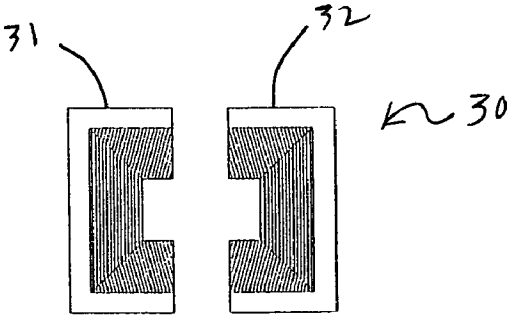
FIG. 6*a* shows a plan view of a two-part lateral support block according to an embodiment of the invention.
Figure 6B:
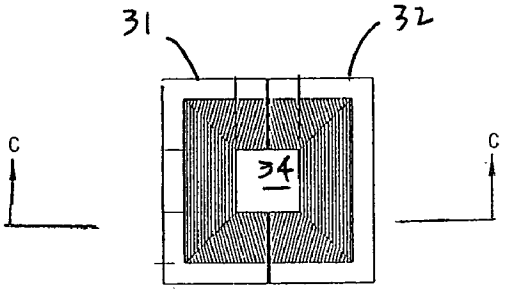
FIG. 6*b* shows a plan view of the two-part lateral support block shown in FIG. 6*a* in an assembled condition.
Figure 6C:
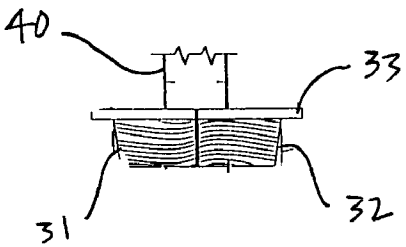
FIG. 6*c* shows a cross section along section CC of the lateral support block shown in FIG. 6*b;*

As shown in FIG. 6*c*, lateral support block 30 may include a flange portion 33 larger than the associated opening 13 in the second deck 12. For example flange 33 may comprise a substantially square sheet of three quarter inch thick plywood with sides measuring approximately fifteen inches in length. Moreover lateral support block 30 has a substantially central opening 34 (FIG. 6*b*) sized and shaped to allow a vertical support post 40 to pass through lateral support block 30. For example, opening 34 may have a substantially square shape with sides measuring approximately four and nine sixteenth inches in length. The sides of lateral support block 30 may extend downwardly into associated opening 13 in deck 12 and may be formed to conform to a taper or shape of opening 13 such that lateral support block 30 is firmly and securely seated in opening 13. For example, sides of lateral support block 30 may extend downwardly approximately three and one half inches from flange 33 into opening 13. These sizes and dimensions are exemplary only, and lateral support block 30 may be of any size and shape appropriate for providing lateral support to an associated vertical support post.

As shown in FIGS. 6*a* and 6*b*, lateral support block 30 may be formed from two or more lateral support block sections 31, 32 which are arranged in proximity to one another to form the substantially central opening 34.

The multi-level fall protection further includes a plurality of vertical support members or posts 40. Each of the vertical support posts 40 is detachably secured at a bottom portion to an associated bearing plate 20, extends upwardly through an associated opening 13 in the second deck 12 and is supported laterally by an associated lateral support block 30.

Vertical support posts 40 may be fabricated from structural aluminum, steel or any material of suitable properties and strength and may have a round, square, rectangular or other shaped cross-section. Vertical support posts may be solid or tubular. Preferably, vertical support posts 40 are of a length and weight such that they may be lifted and positioned ("jumped") from one floor to the next by hand (manpower).

Figure 3:
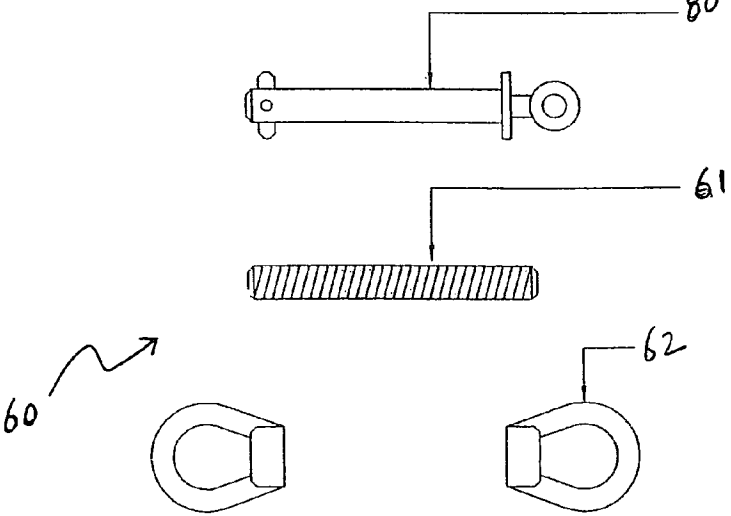
FIG. 3 show some exemplary hardware for coupling a vertical support post to a bearing plate and for coupling a flexible support line to a vertical support post according to embodiments of the invention.

Vertical support posts 40 may include have a plurality of spaced apart openings 41 therethrough for receiving a respective fastener 60 for securing a respective end of a flexible support line 50 to the vertical support post. Fastener 60 may comprise, for example, an eye bolt or an eye nut, or any fastener suitable for securing an end of a flexible support line 50 to post 40. For example, as shown in FIG. 3, fastener 60 may include a length of three quarter inch diameter threadbar 61 and a pair of three quarter inch shouldered eye nuts threaded onto each end of the threadbar.

Vertical support posts 40 may further comprise a plurality of tubular sections 42, 43 coupled together. For example, FIG. 1*a* shows a side view and a frontal view of an upper vertical support post according to an embodiment of the invention. The upper vertical support post may comprise a thirteen foot length of four inch nominal diameter schedule 80 aluminum pipe or tube having an outer diameter of approximately 4.5 inches and a wall thickness of approximately 0.337 inches. Spaced apart openings 41 may be provided on the post spaced at approximately six inches on center. FIG. 1*b* shows a side view and a frontal view of a lower vertical support post according to an embodiment of the invention. The lower vertical support post may comprise a thirteen foot length of four inch nominal diameter schedule 40 aluminum pipe or tube having an outer diameter of approximately 4.5 inches and a wall thickness of approximately 0.237 inches. Spaced apart openings 41 may be provided on the lower post spaced at approximately six inches on center.

Figure 1C:
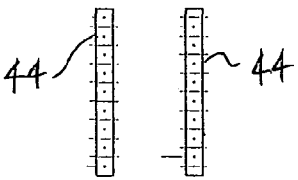
FIG. 1*c* shows a side view and a frontal view of a splicing member for a vertical support post according to an embodiment of the invention.
Figure 1A:
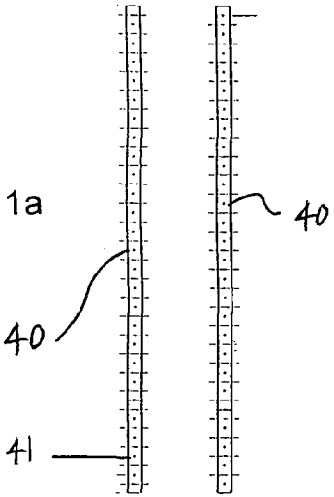
FIG. 1*a* shows a side view and a frontal view of an upper vertical support post according to an embodiment of the invention.
Figure 1B:
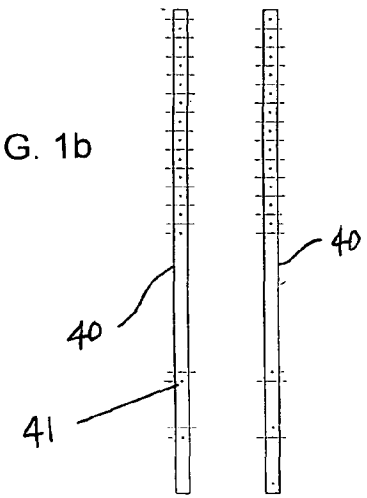
FIG. 1*b* shows a side view and a frontal view of a lower vertical support post according to an embodiment of the invention.
Figure 2:
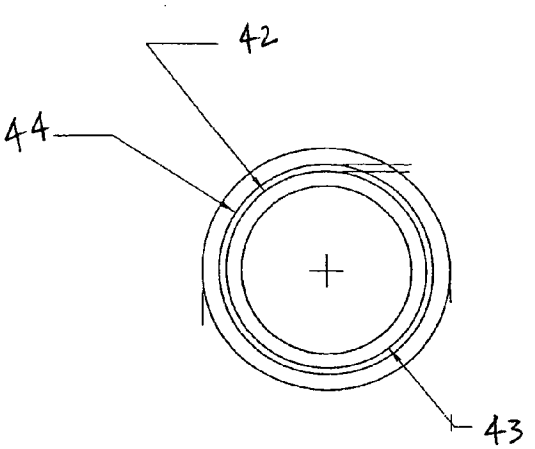
FIG. 2 shows cross section of a vertical support post comprising a plurality of tubular sections according to an embodiment of the invention.

FIG. 1*c* shows a side view and a frontal view of a splicing member 44 used to join an upper and lower vertical support post Splicing member 44 may comprise a four and one half foot length of four and one half inch nominal diameter schedule 80 aluminum pipe or tube having an outer diameter of approximately 5.563 inches and a wall thickness of approximately 0.375 inches. Spaced apart openings 41 may be provided on the splicing member 44 spaced at approximately six inches on center. A portion of upper 42 and lower 43 vertical support posts may be inserted into the splicing member 44 and secured by inserting an appropriate fastener. FIG. 2 shows cross section of a vertical support post 40 comprising a plurality of tubular sections 42, 43 and a splicing member 44 according to an embodiment of the invention.

FIG. 1*d* shows a side view of a vertical support post 40 extending between multiple reinforced concrete decks according to an embodiment of the invention. As shown, vertical support post 40 may comprise a number of sections spliced or otherwise joined together to stand three working levels in height. The vertical support post 40 is laterally supported at all three levels (by lateral support blocks 30 at the upper levels and bearing plate 20 at a first level) and vertically supported by a bearing plate 20 at a base only.

The vertical support posts 40 provide vertical and horizontal anchorages for horizontal lifelines and handrail systems provided at each level of the structure under construction. For example, the vertical support posts may be arranged approximately twenty feet apart on center along a perimeter and interior portions of the structure. At the uppermost working level, the vertical support posts act as interconnected cantilevered supports which provide varying degrees of flexibility dependent on the number of spans in line and the location of the posts along a particular run. At the lower levels, where bracing is provided by lateral support blocks or bearing plates, the anchorage deflection is much less pronounced.

At least one flexible support line 50 extends between and is coupled to a pair of the vertical support posts 40. Flexible support line 50 may comprise a solid or stranded cable, nylon strapping, robe or any other flexible line of appropriate strength. Flexible support line 50 may include an eye at one or both ends to facilitate rigging the line to vertical support posts 40.

Figure 7:
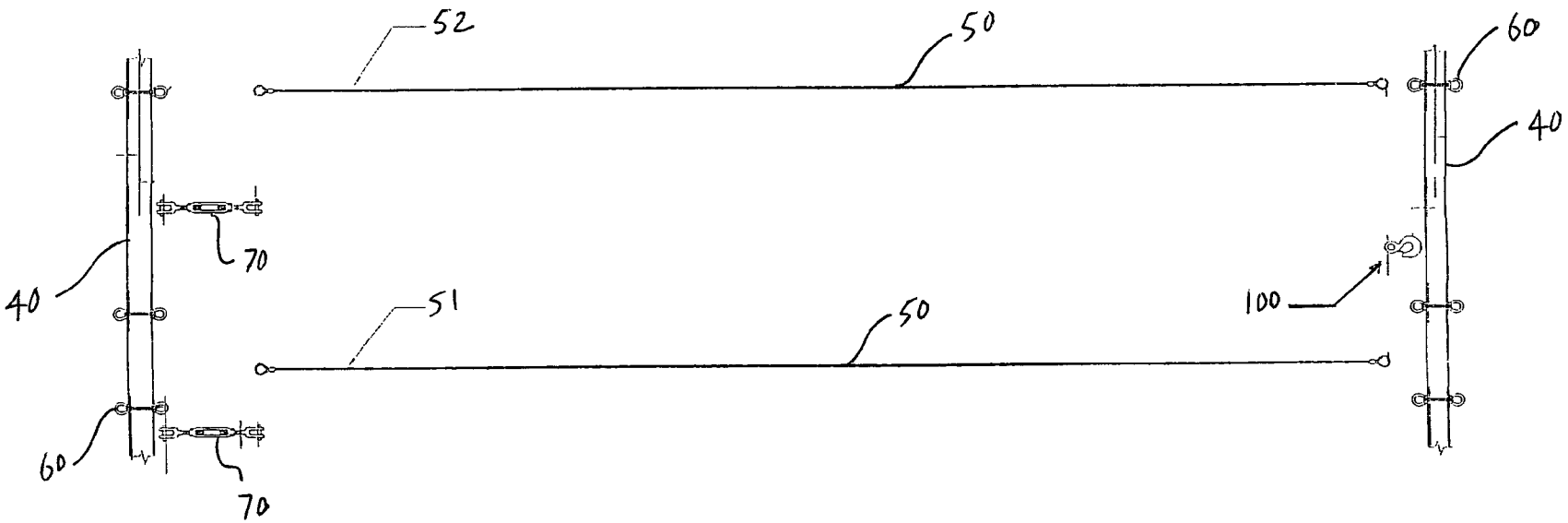
FIG. 7 shows a portion of a multi-level fall protection system according to an embodiment of the invention, including flexible support lines and hardware for coupling the support lines to the vertical support posts.

FIG. 7 shows a portion of a multi-level fall protection system according to an embodiment of the invention, including flexible support lines 50 and hardware for coupling the support lines to the vertical support posts. As shown, the flexible support lines may comprises a handrail 51 for preventing a fall and or a lifeline 52 for arresting a fall.

Preferably, the multi-level fall protection system is arranged such that a plurality of handrails and/or lifelines extend around a perimeter of one or more decks of the structure. Additionally, one or more lifelines may extend along an interior portion of one or more of the decks. In this way, a multi-level fall protection system according to an embodiment of the invention can provide both handrails for fall prevention and lifelines for fall arrest.

With respect to the lifelines 52, workers or other personnel on the structure typically wear safety harnesses which are tethered to the lifelines by a lanyard. Should a worker fall, the lifeline 52 which is coupled to the worker's harness via the lanyard, will arrest the worker's fall. In addition to preventing and arresting falls, a system according to the invention may be used to rescue a worker who has fallen and is suspended from a safety cable by attaching a boom mounted hoist to an anchoring member on a pole, lowering a line for the fallen person to hook to their harness, and lifting the person to safety.

As shown in FIG. 7, both the handrails 51 and lifelines 52 may be similarly rigged, however the handrail and lifeline support lines and rigging hardware will typically have different requirements and specifications. For example, a suitable handrail line may be one quarter inch diameter type 304 stainless steel stranded cable, 7×19 IWRC. A suitable lifeline may comprise three eighth inch diameter type 304 stainless steel stranded cable, 7×19 IWRC. Both the handrails and lifelines may be detachably coupled to the fasteners 60 disposed at the desired heights on the respective vertical support posts using an appropriate fastener 100, such as a snap hook, carabiner or the like. An example of a suitable fastener 100 for coupling a flexible support line 50 to an eye bolt or eye nut mounted to vertical support post 40 is a 1.75 inch opening self locking snap hook.

A tensioning mechanism 70 may be coupled to the flexible support line 50 to impart an appropriate tension on the support line. Tensioning mechanism 70 may be, for example, a turnbuckle, such as a one half inch nominal diameter turnbuckle with six inches of take-up for a handrail 51 or a three quarter inch nominal diameter turnbuckle with six inches of take-up for a lifeline 52.

The multi-level fall protection system according to the invention and all of its components should meet all applicable safety and/or regulatory standards. For example, with respect to the handrail system, the breaking strength of any individual component should exceed twice the maximum calculated load. The top handrail and mid handrail should have a minimum diameter of one quarter inch. The top rail should be capable of supporting a 200 pound load from any direction and should not sag below 39 inches upon maximum load. The mid handrail should be positioned approximately 18 inches below the top hand rail and should be capable of supporting a 150 pound load from any direction.

With respect to the lifeline system, the breaking strength of any individual component should exceed twice the maximum calculated load. Worker deceleration should be limited to a 900 pound load with personal shock absorber deployment limited to 42 inches. A worker should not come into contact with any obstacles during a fall and the worker's free fall distance should be limited to six feet.

Figure 8:
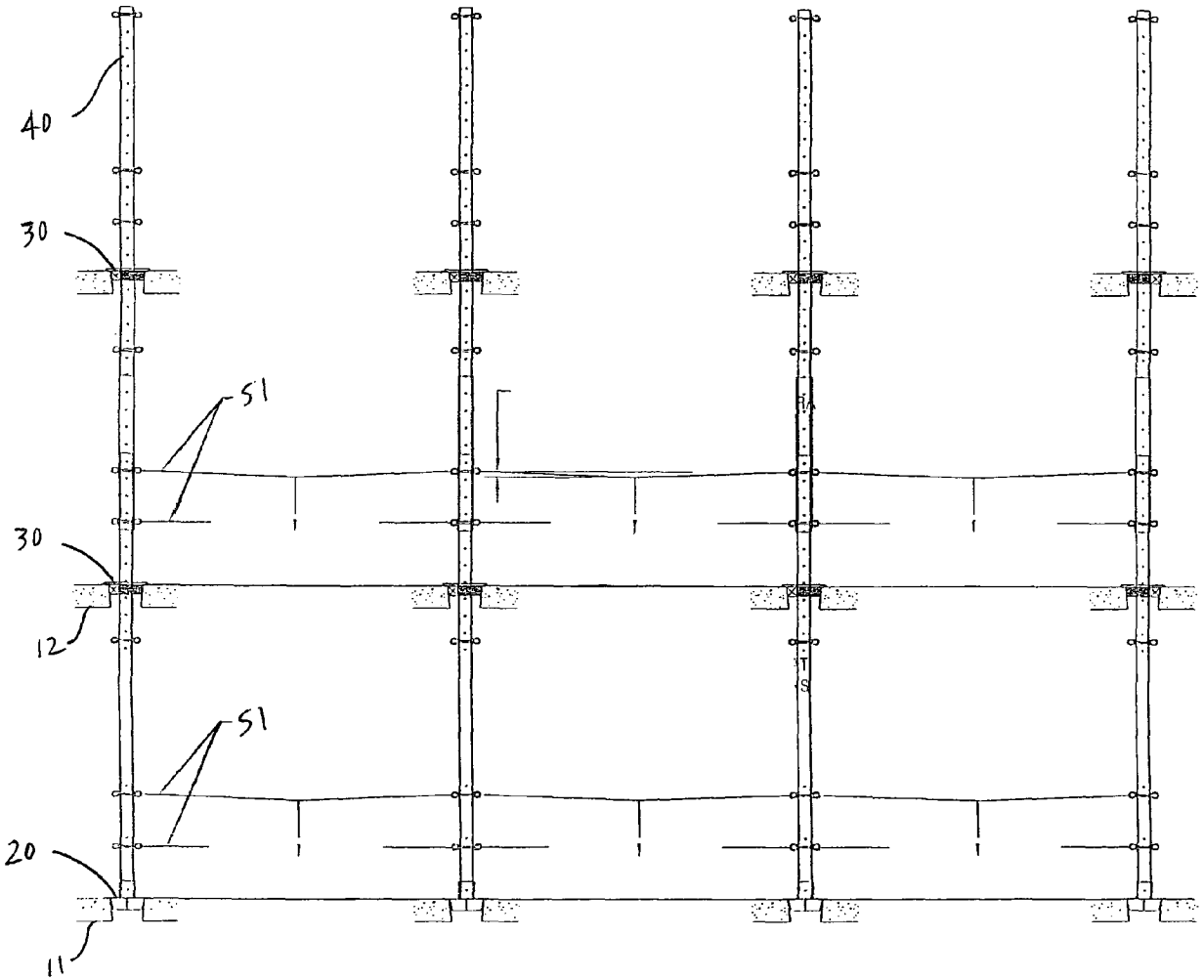
FIG. 8 shows a multi-level fall protection system according to an embodiment of the invention with flexible support lines configured as handrails and being calibrated.

FIG. 8 shows a multi-level fall protection system according to an embodiment of the invention with flexible support lines configured as handrails 51 and being calibrated. Handrails 51 should be calibrated on installation as follows. A 20 pound calibration weight is hung from a top handrail at a center span of the section or sections being calibrated. A 1.5 to 2.0 inch calibration cusp is allowable at all top rails. The lower hand rails have lesser requirements and should be set taught without exceeding the free hanging tension of the upper handrail.

Figure 9:
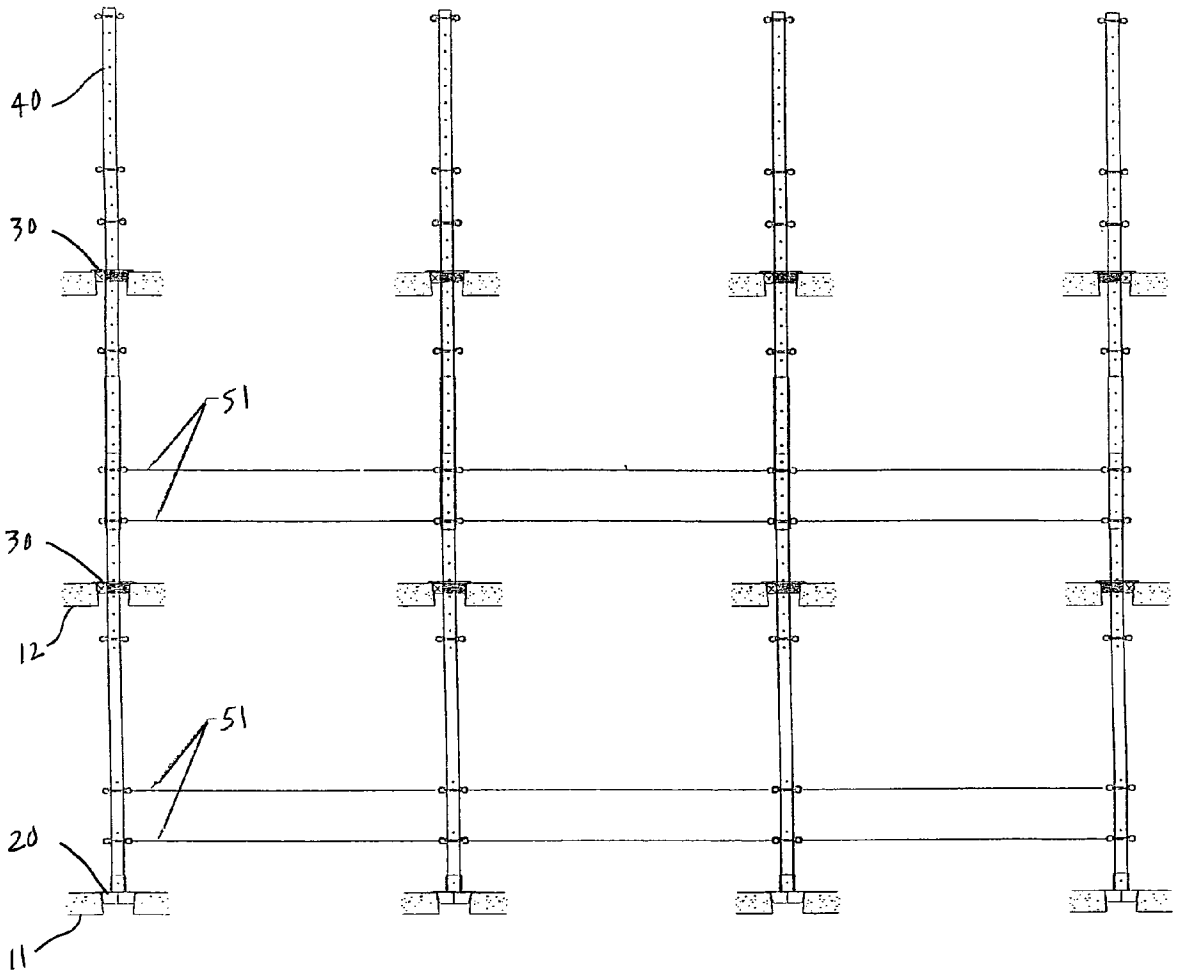
FIG. 9 shows the multi-level fall protection system shown in FIG. 8 with the handrails at rest.
Figure 10:
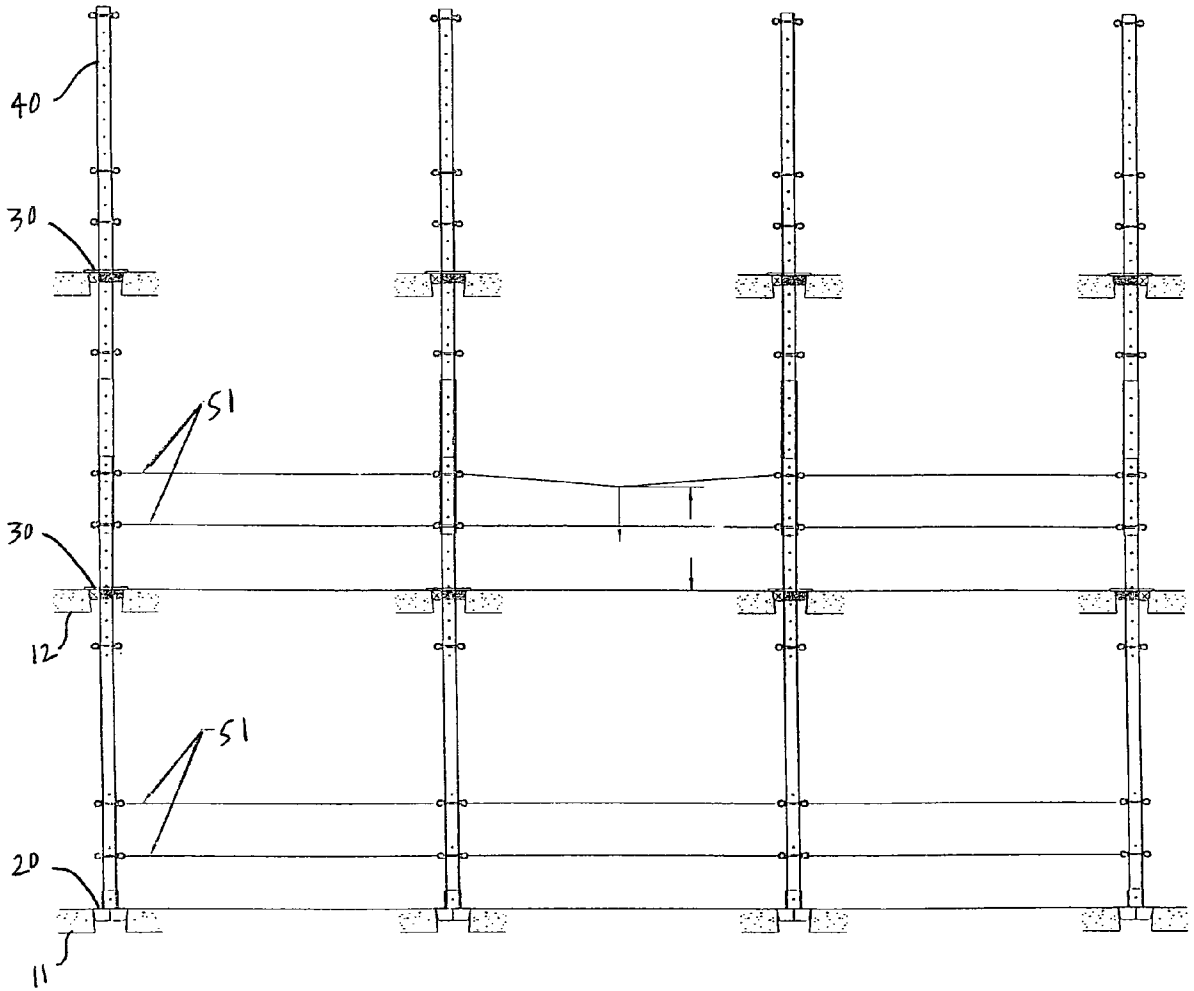
FIG. 10 shows the multi-level fall protection system shown in FIG. 8 with a handrail being subject to a load.

FIG. 9 shows the multi-level fall protection system shown in FIG. 8 with the handrails at rest. A maximum allowable sag for the top handrail at rest may be one quarter inch. FIG. 10 shows the multi-level fall protection system shown in FIG. 8 with a handrail being subject to a load. For example under a 200 pound, a top handrail initially at 45 inches above the deck should have a maximum deflection to 39 inches above the deck.

Figure 11:
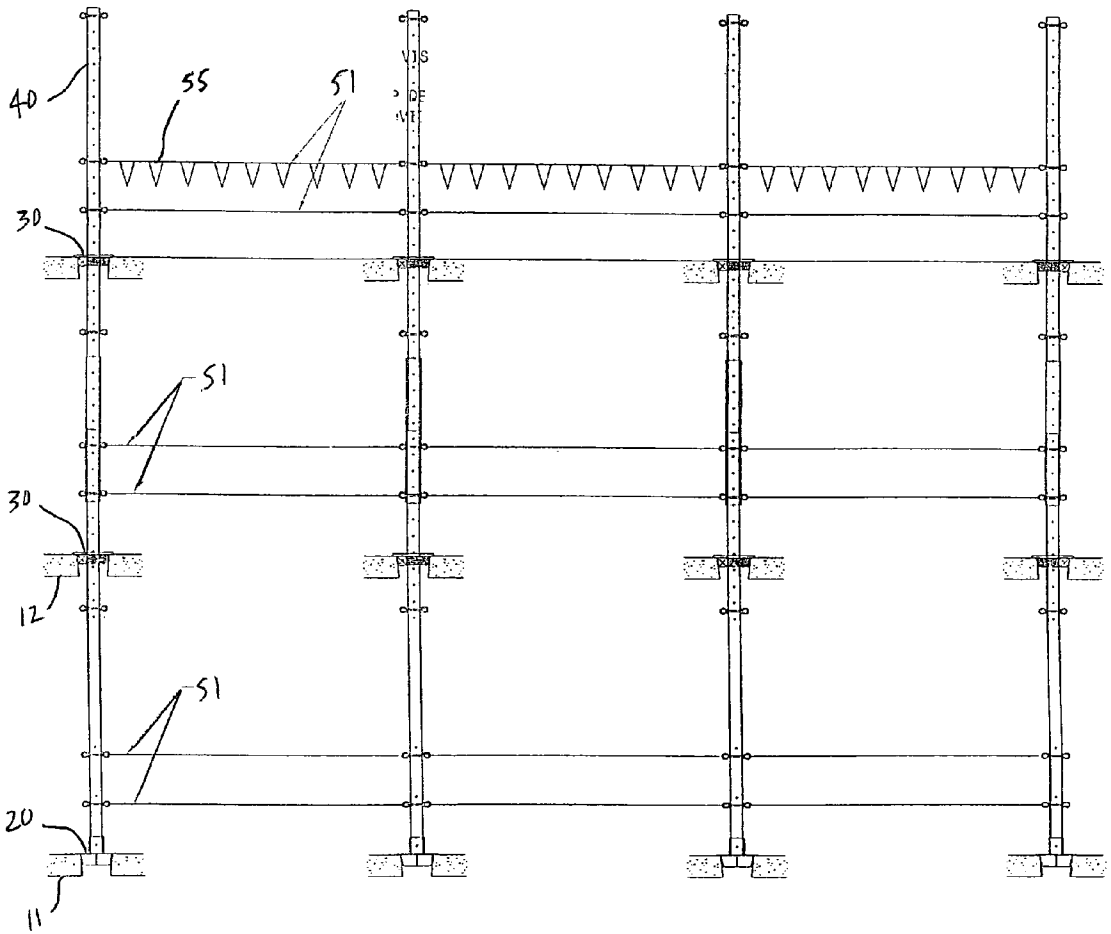
FIG. 11 shows a multi-level fall protection system according to an embodiment of the invention with flexible support lines configured as handrails and visual barriers provided on the upper handrail of the top deck of a structure under construction.

FIG. 11 shows a multi-level fall protection system according to an embodiment of the invention with flexible support lines configured as handrails 51 and visual barriers 55 provided on the upper handrail of the top deck of a structure under construction. Visual barriers 55 may comprise flags, ribbon or the like and improve visibility and awareness of the perimeter edge of the structure under construction. The visual barrier line may be provided, for example at the uppermost working level of the structure and may have no structural requirements. At this level, workers must be attached to a lifeline, as no functioning handrails may be provided. The visual barrier line may be transformed into a handrail as the next deck or floor is erected and the system is raised or jumped to the next floor.

Figure 12:
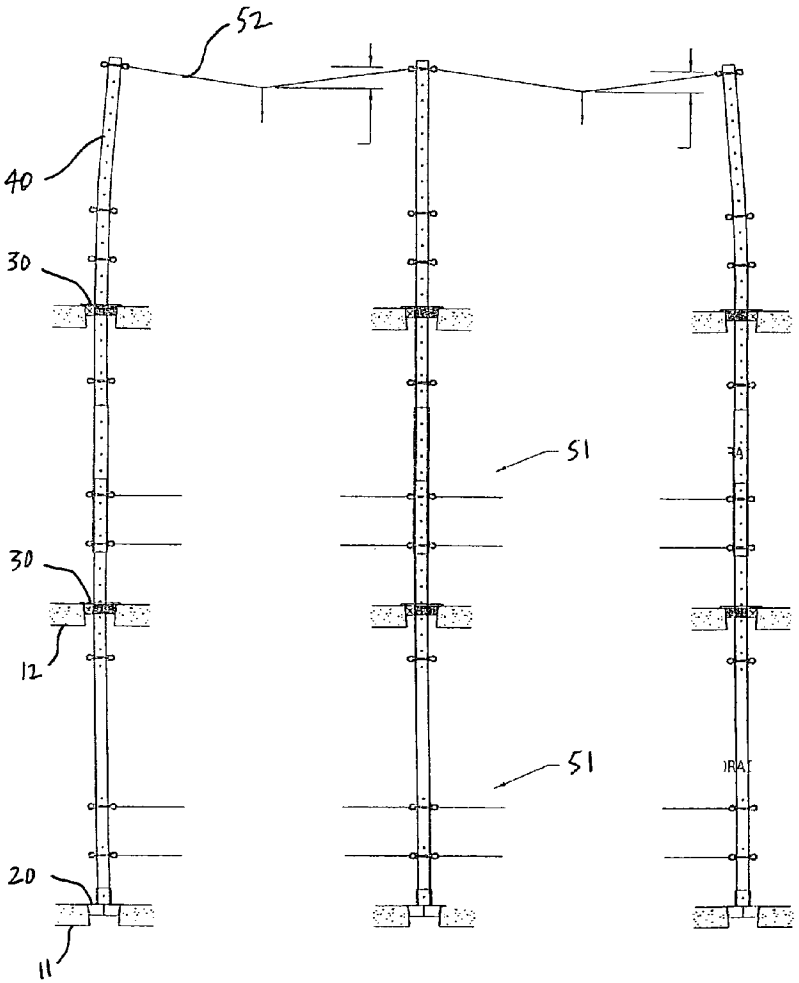
FIG. 12 shows a multi-level fall protection system according to an embodiment of the invention with flexible support lines configured as handrails and lifelines, with the lifelines being calibrated.
Figure 13:
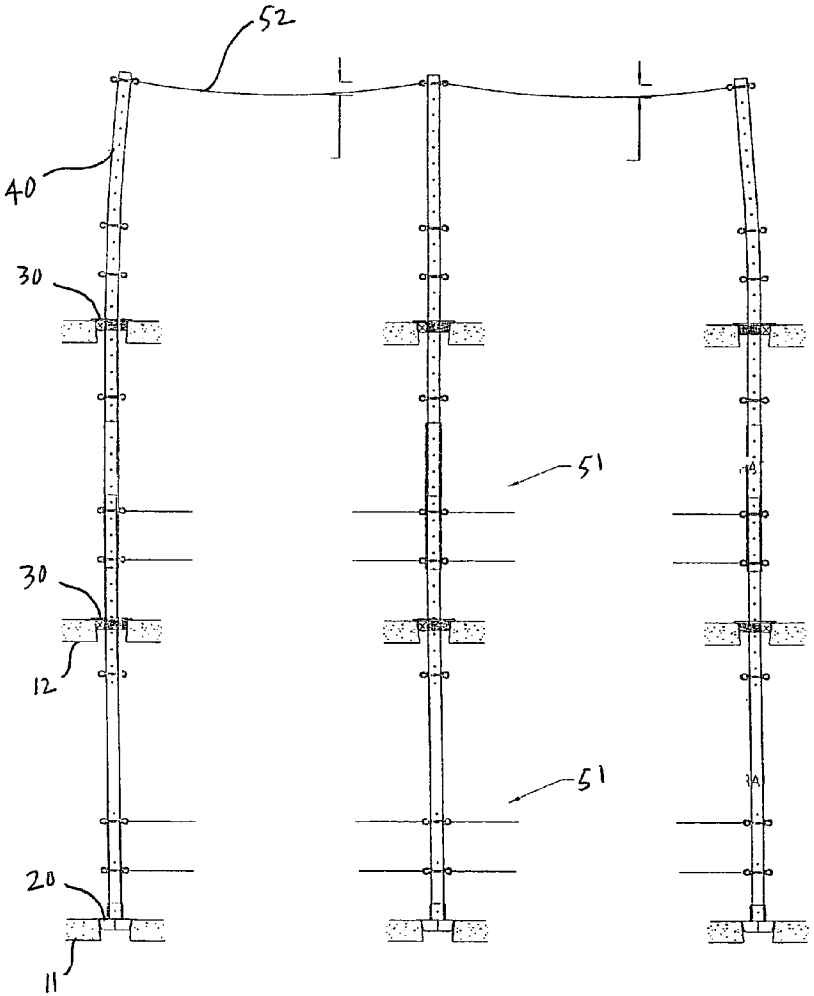
FIG. 13 shows the multi-level fall protection system shown in FIG. 12 with the lifelines at rest.
Figure 14:
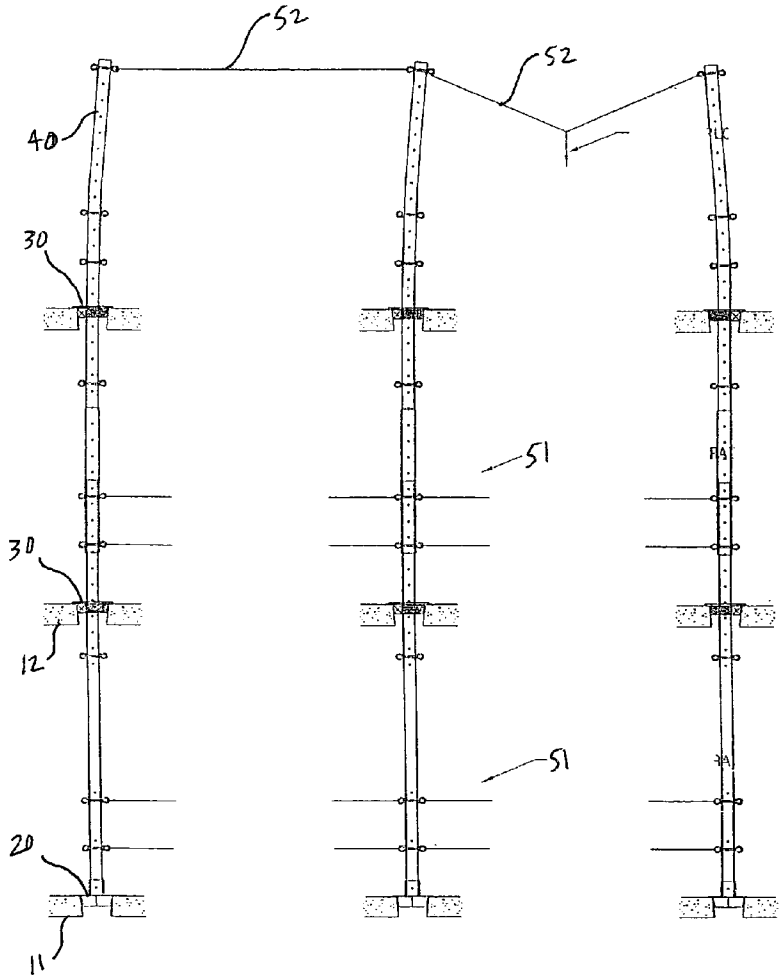
FIG. 14 shows the multi-level fall protection system shown in FIG. 12 with a lifeline being subject to a load.

FIG. 12 shows a multi-level fall protection system according to an embodiment of the invention with flexible support lines configured as handrails 51 and lifelines 52 with the lifelines 52 being calibrated. The horizontal lifelines 52 must be calibrated based on the location and configuration of the particular system. A ten pound calibration weight may be used and a three inch initial cup may be typical. FIG. 13 shows the multi-level fall protection system shown in FIG. 12 with the lifelines at rest. The lifelines 52 may sag by approximately one and one quarter inch at rest. FIG. 14 shows the multi-level fall protection system shown in FIG. 12 with a lifeline being subject to a load simulating a fall arrest, for example a 900 pound deployment load.

Figure 15:
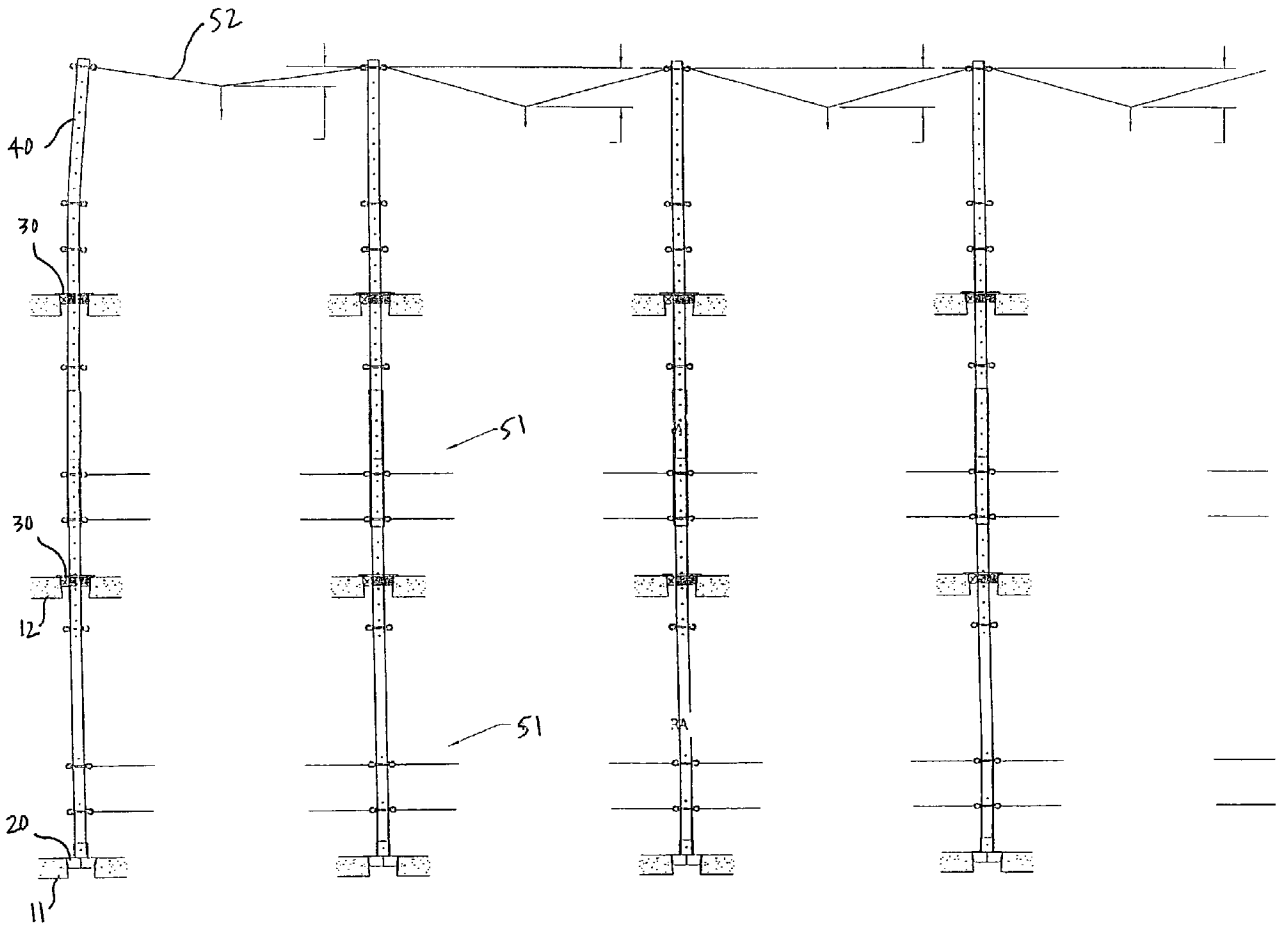
FIG. 15 shows a multi-level fall protection system according to an embodiment of the invention with flexible support lines configured as handrails and lifelines, with the lifelines being calibrated.
Figure 16:
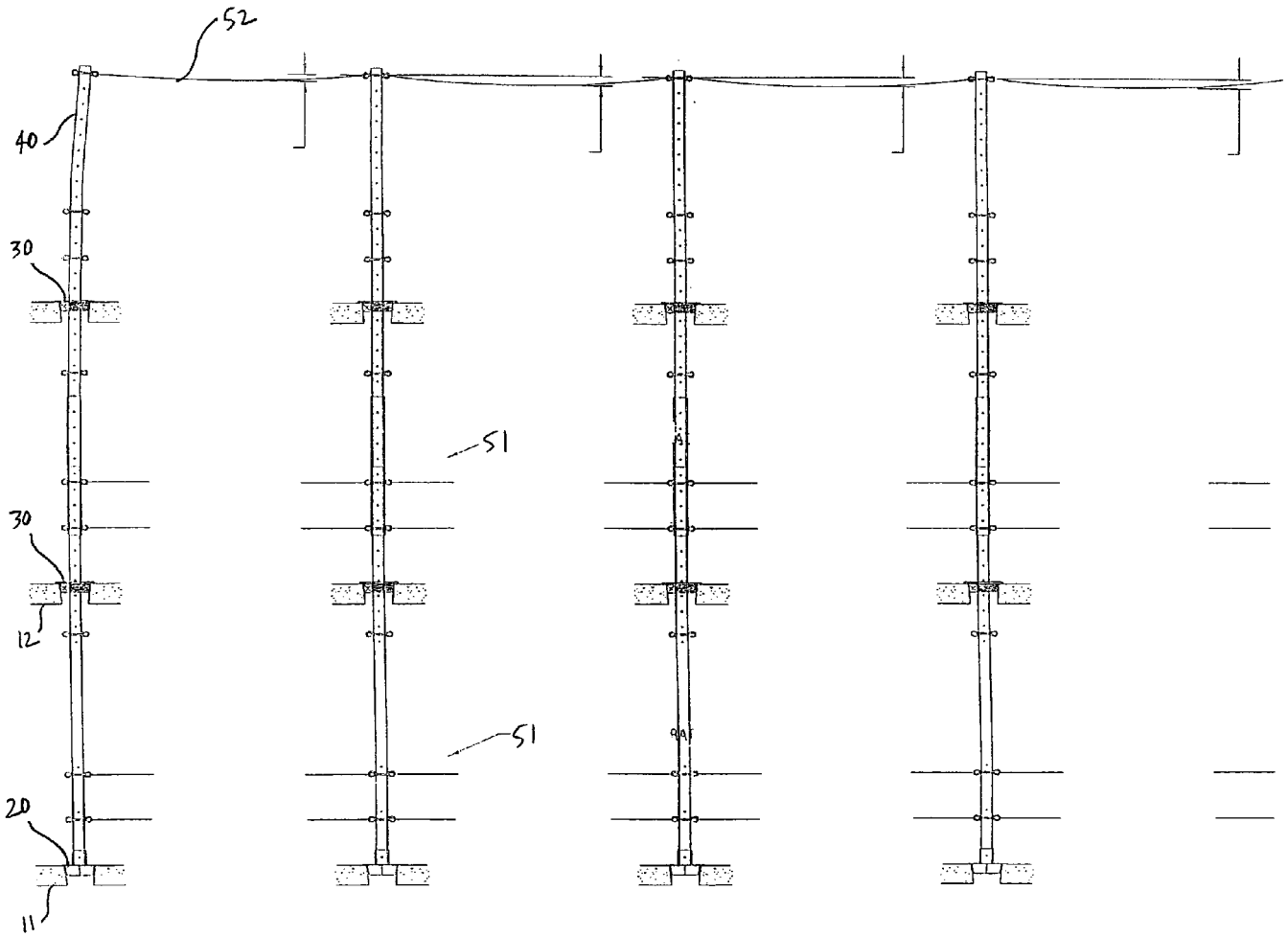
FIG. 16 shows the multi-level fall protection system shown in FIG. 15 with the lifelines at rest.

FIG. 15 shows a multi-level fall protection system according to an embodiment of the invention with flexible support lines configured as handrails 51 and lifelines 52, with the lifelines 52 being calibrated. FIG. 16 shows the multi-level fall protection system shown in FIG. 15 with the lifelines 52 at rest.

Figure 17:
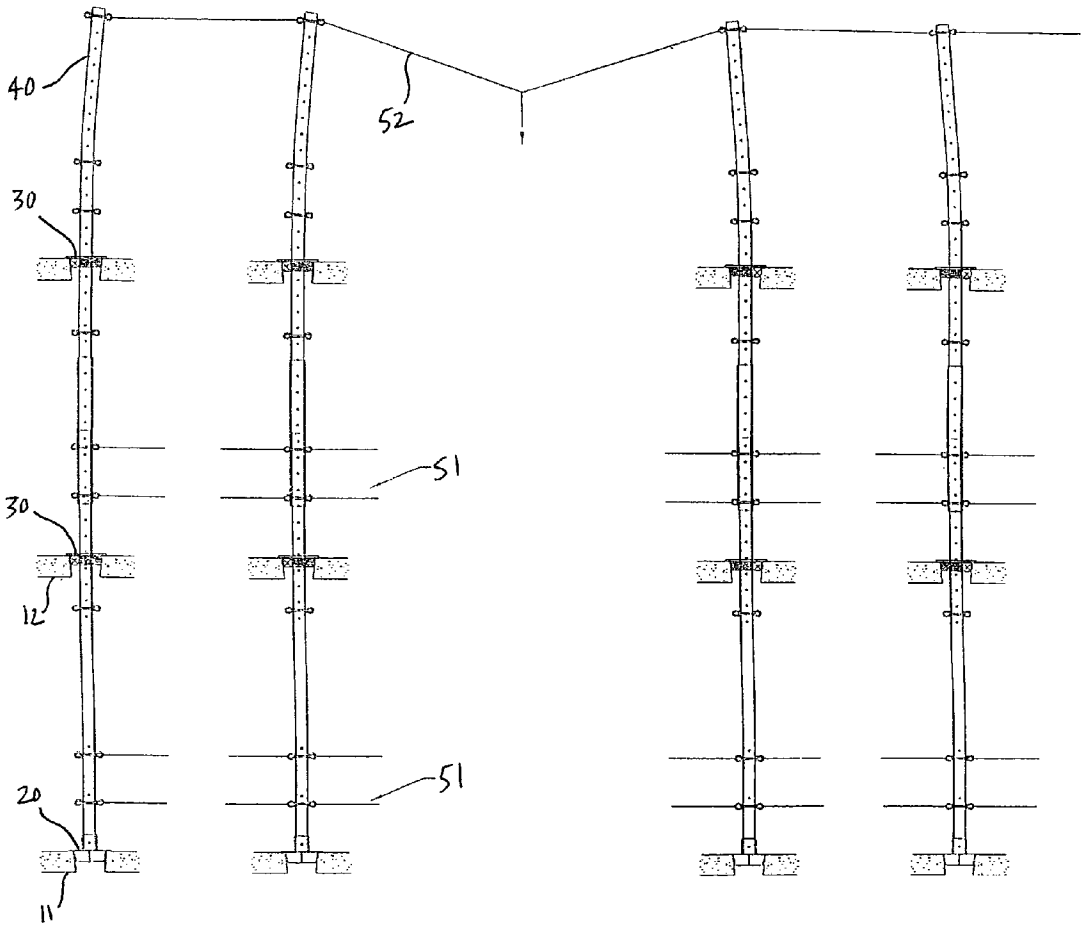
FIG. 17 shows the multi-level fall protection system shown in FIG. 15 with a lifeline of an interior span being subject to a load.
Figure 18:
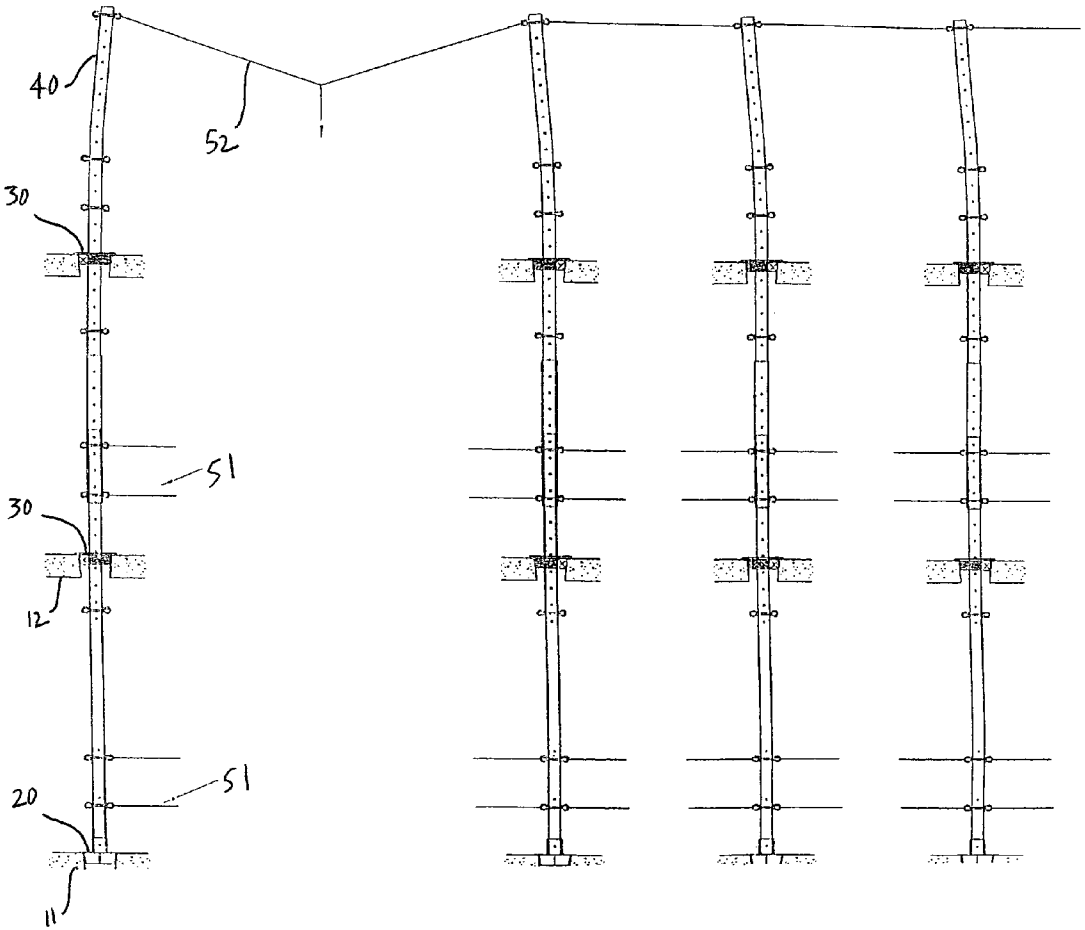
FIG. 18 shows a multi-level fall protection system according to an embodiment of the invention with a lifeline of an exterior span being subject to a load.

FIG. 17 shows the multi-level fall protection system shown in FIG. 15 with a lifeline 52 of an interior span being subject to a load and FIG. 18 shows a multi-level fall protection system according to an embodiment of the invention with a lifeline of an exterior span being subject to a load.

Figure 19:
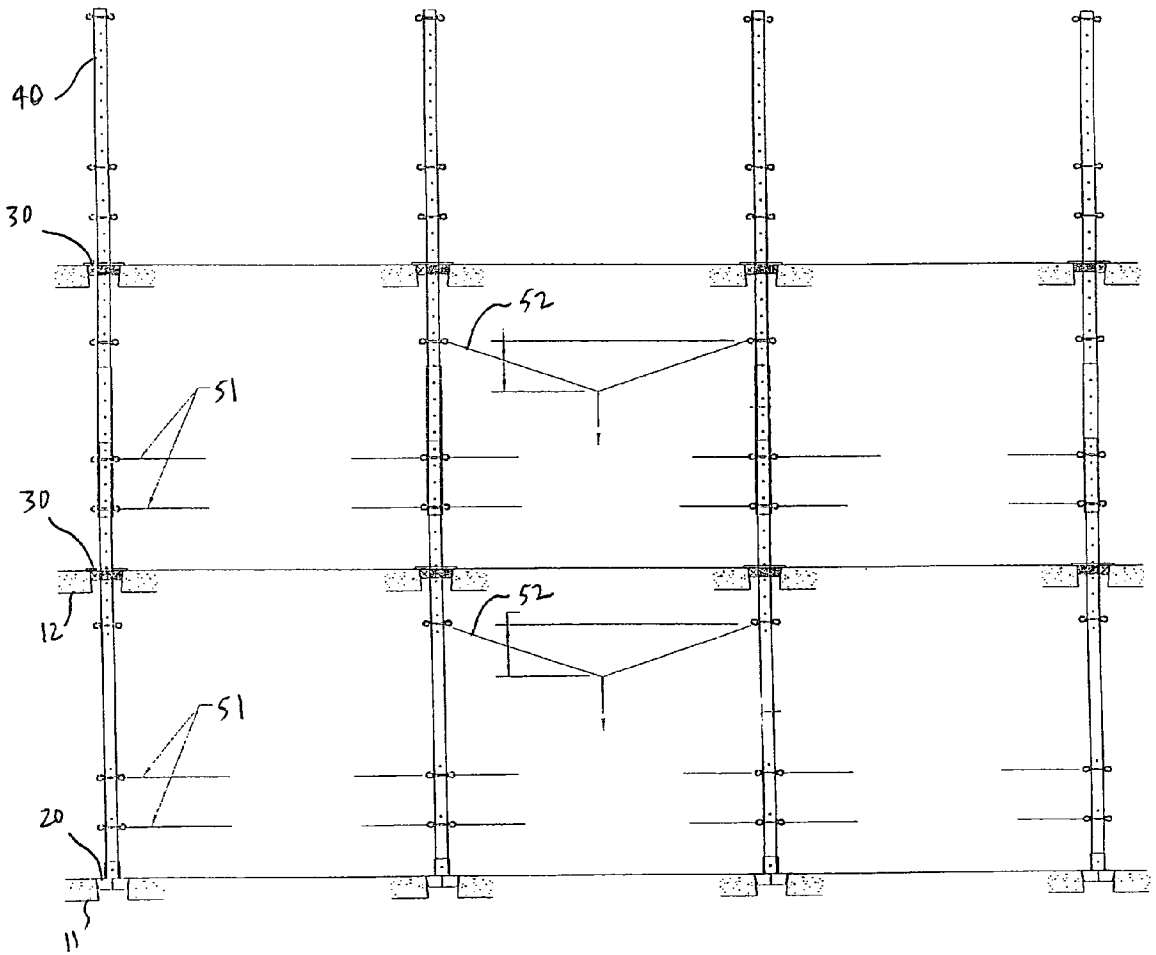
FIG. 19 shows a multi-level fall protection system according to an embodiment of the invention with flexible support lines configured as handrails and lifelines, with the lifelines positioned on the lower levels of the structure and being calibrated.
Figure 20:
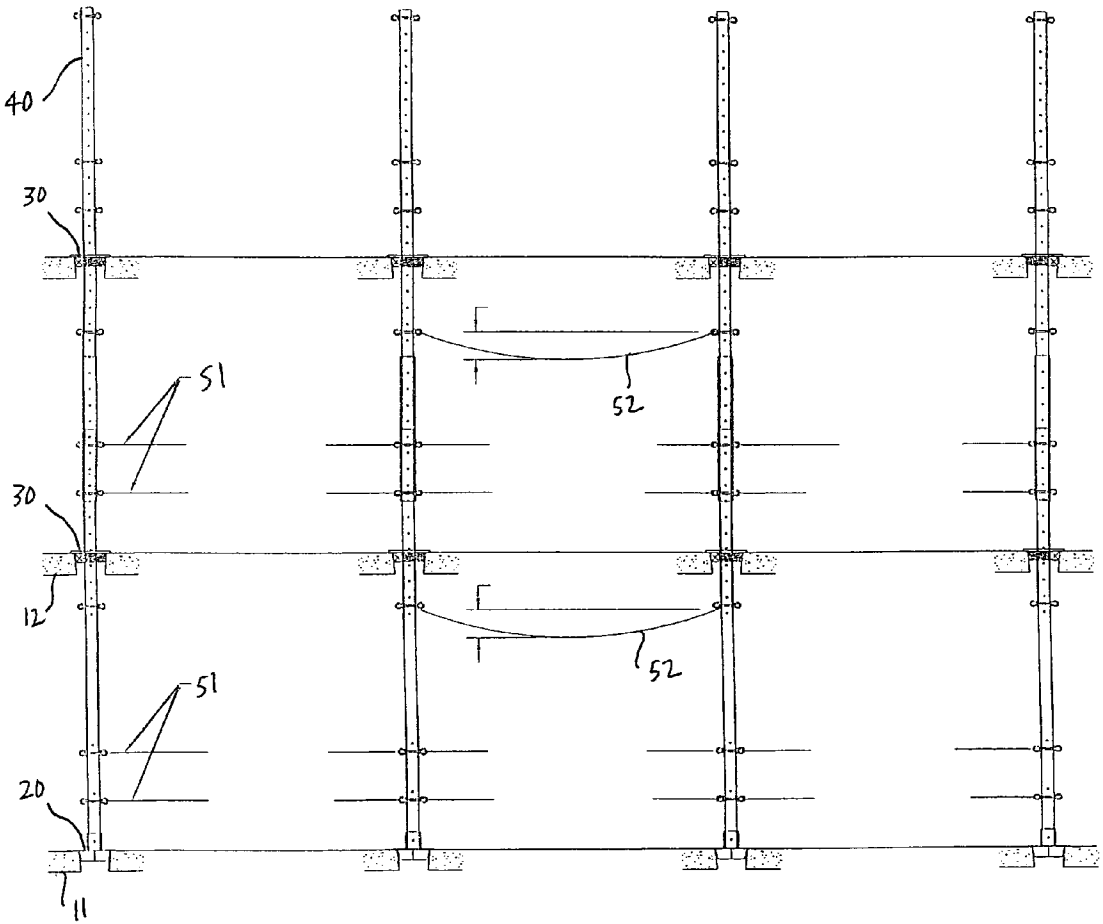
FIG. 20 shows the multi-level fall protection system shown in FIG. 19 with the lifelines at rest.
Figure 21:
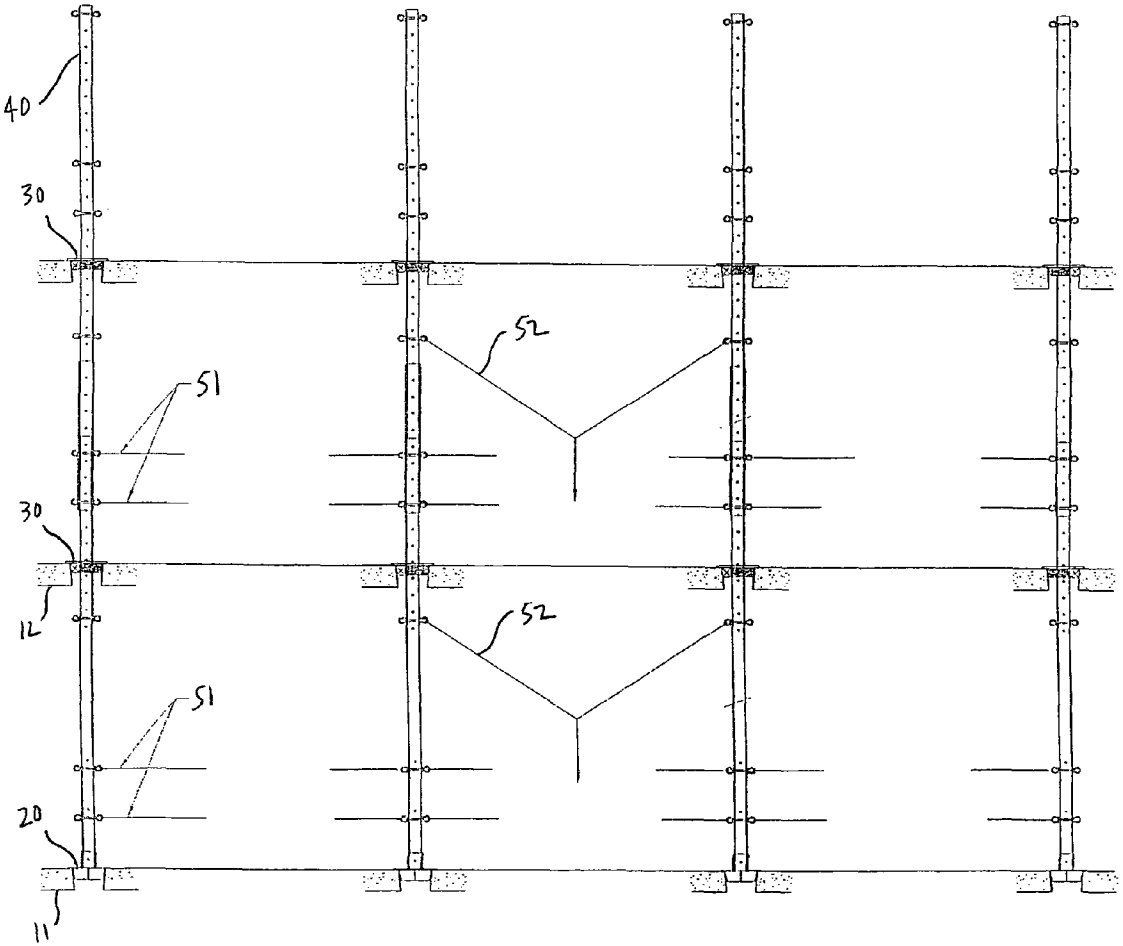
FIG. 21 shows the multi-level fall protection system shown in FIG. 19 with the lifelines being subject to a load.

FIG. 19 shows a multi-level fall protection system according to an embodiment of the invention with flexible support lines configured as handrails 51 and lifelines 52, with the lifelines 52 positioned on the lower levels of the structure and being calibrated. For example, lifelines 52 may be calibrated with a ten pound load and deflect a maximum of approximately 18 inches. FIG. 20 shows the multi-level fall protection system shown in FIG. 19 with the lifelines 52 at rest. At rest, lifelines 52 may sag, for example, a maximum of approximately 16 inches. FIG. 21 shows the multi-level fall protection system shown in FIG. 19 with the lifelines being subject to a load simulating a fall arrest, for example a 900 pound deployment load.

Accordingly, while several embodiments of the present invention have been shown and described, it is obvious that many changes and modifications may be made thereunto without departing from the spirit and scope of the invention.

What is claimed is:

1. A multi-level fall protection system for a structure under construction, the structure having a plurality of reinforced concrete decks with a plurality of openings provided in the decks, the plurality of decks including a first deck and a second deck arranged above the first deck, the system comprising:

a) a plurality of bearing plates, each of said plurality of bearing plates arranged in an associated opening in the first deck and comprising a flange portion larger than the associated opening;

b) a plurality of lateral support blocks, each of said plurality of lateral support blocks arranged in an associated opening in the second deck;

c) a plurality of vertical support posts, each of said plurality of vertical support posts being detachably secured at a bottom portion to an associated bearing plate of said plurality of bearing plates, extending upwardly through an associated opening in the second deck and being supported laterally by an associated lateral support block of said plurality of lateral support blocks; and d) at least one flexible support line extending between and coupled to a pair of said plurality of vertical support posts.

2. The multi-level fall protection system according to claim 1, wherein said pair of said plurality of vertical support posts have a plurality of spaced apart openings therethrough for receiving a respective fastener, said respective fastener for securing a respective end of a flexible support line of said plurality of flexible support lines to said pair of said plurality of vertical support posts.

3. The multi-level fall protection system according to claim 1, wherein at least one of said plurality of vertical support posts comprises a plurality of tubular sections coupled together.

4. The multi-level fall protection system according to claim 1, further comprising a tensioning mechanism coupled to said at least one flexible support line.

5. The multi-level fall protection system according to claim 1, wherein said at least one flexible support line extending between and coupled to a pair of said plurality of vertical support posts comprises a plurality of flexible support lines extending between and coupled to a plurality of pairs of said plurality of vertical support posts.

6. The multi-level fall protection system according to claim 5, wherein at least one of said plurality of flexible support lines comprises a handrail for preventing a fall.

7. The multi-level fall protection system according to claim 5, wherein at least one of said plurality of flexible support lines comprises a lifeline for arresting a fall.

8. The multi-level fall protection system according to claim 5, wherein said plurality of flexible support lines comprises a plurality of handrails extending around a perimeter of at least one of the plurality of decks.

9. The multi-level fall protection system according to claim 5, wherein said plurality of flexible support lines comprises a plurality of lifelines extending along an interior portion of at least one of the plurality of decks.

10. The multi-level fall protection system according to claim 1, wherein at least one bearing plate of said plurality of bearing plates comprises a connection member projecting upwardly from said flange portion, said connection member sized and shaped to receive said bottom portion of said vertical support post.

11. The multi-level fall protection system according to claim 10, wherein said connection member has a first opening therethrough, said bottom portion of said vertical support post has a second opening therethrough, and said bottom portion of said vertical support post is detachably secured to said connection member with a pin inserted through said first and second opening.

12. The multi-level fall protection system according to claim 1, wherein at least one lateral support block of said plurality of lateral support bocks comprises a flange portion larger than the associated opening in the second deck and wherein said at least one lateral support block has a substantially central opening for allowing a vertical support post of the plurality of vertical support posts to pass through said at least one lateral support block.

13. The multi-level fall protection system according to claim 12, wherein said at least one lateral support block comprises at least two lateral support block sections, said at least two lateral support block sections being arranged in proximity to one another to form said substantially central opening in said at least one lateral support block.

14. A method for providing a multi-level fall protection system for a structure under construction, the structure having a plurality of reinforced concrete decks with a plurality of openings provided in the decks, the plurality of decks including a first deck and a second deck arranged above the first deck, the method comprising the steps of:

a) arranging a each of a plurality of bearing plates in an associated opening in the first deck, wherein said bearing plates comprise a flange portion larger than the associated opening in the first deck;

b) arranging each of a plurality of vertical support posts so as to extend upwardly from the first deck through an associated opening in the second deck;

c) detachably securing a bottom portion of said vertical support posts to an associated bearing plate of said plurality of bearing plates;

d) arranging each of a plurality of lateral support blocks in an associated opening in the second deck for laterally supporting an associated vertical support post of said plurality of vertical support posts; and e) coupling at least one flexible support line to each of a pair of vertical support posts of said plurality of vertical support posts so as to extend between said pair of vertical support posts.

* * * * *